US010565852B2

(12) United States Patent
Moser et al.

(10) Patent No.: US 10,565,852 B2
(45) Date of Patent: Feb. 18, 2020

(54) SECURITY ELEMENT FOR AN OBJECT SURFACE

(71) Applicant: eologix sensor technology gmbh, Graz (AT)

(72) Inventors: Michael Moser, Graz (AT); Thomas Schlegl, Soeding (AT); Hubert Zangl, Graz (AT)

(73) Assignee: eologix sensor technology gmbh, Graz (AT)

( * ) Notice: Subject to any disclaimer, the term of this patent is extended or adjusted under 35 U.S.C. 154(b) by 0 days.

(21) Appl. No.: 16/315,274

(22) PCT Filed: Jul. 5, 2017

(86) PCT No.: PCT/AT2017/060167

§ 371 (c)(1),
(2) Date: Jan. 4, 2019

(87) PCT Pub. No.: WO2018/006111

PCT Pub. Date: Jan. 11, 2018

(65) Prior Publication Data

US 2019/0311601 A1 Oct. 10, 2019

(30) Foreign Application Priority Data

Jul. 5, 2016 (AT) ..... A 50597/2016

(51) Int. Cl.
*G08B 21/00* (2006.01)
*G08B 21/22* (2006.01)
(Continued)

(52) U.S. Cl.
CPC ..... *G08B 21/22* (2013.01); *G07C 9/00182* (2013.01); *G08B 13/10* (2013.01);
(Continued)

(58) Field of Classification Search
CPC .. G08B 13/149; G08B 13/26; G08B 21/0469; G08B 21/22; G01R 27/2605
(Continued)

(56) References Cited

U.S. PATENT DOCUMENTS 9,909,568 B2 * 3/2018 Moser ..... B64D 15/20
2005/0257628 A1 11/2005 Nikaido et al.
(Continued)

FOREIGN PATENT DOCUMENTS

DE 9012749 U1 2/1991
EP 2 050 426 A1 4/2009
(Continued)

OTHER PUBLICATIONS

International Search Report of PCT/AT2017/060167, dated Nov. 28, 2017.

*Primary Examiner* — Toan N Pham
(74) *Attorney, Agent, or Firm* — Collard & Roe, P.C.

(57) ABSTRACT

A security element for an object surface separated by a vertical distance, in particular an object height, from a floor area, includes a longitudinally extending flat support body including a first and second flat side. The first flat side is designed to be placed on the object surface. A presence detector and an evaluation unit are mounted on the second flat side, and the support body is made of a flexible material. The presence detector includes a detection region spatially extending around the presence detector away from the first flat side. The detection region is formed by a near-field region, and the evaluation unit includes an electrical energy storage device. The presence detector forms a measuring unit including an electrical characteristic variable. The presence detector also includes at least two electrically conductive electrodes, the electrodes being formed substantially along the entire longitudinal extent of the support body.

23 Claims, 3 Drawing Sheets

Figure 1:
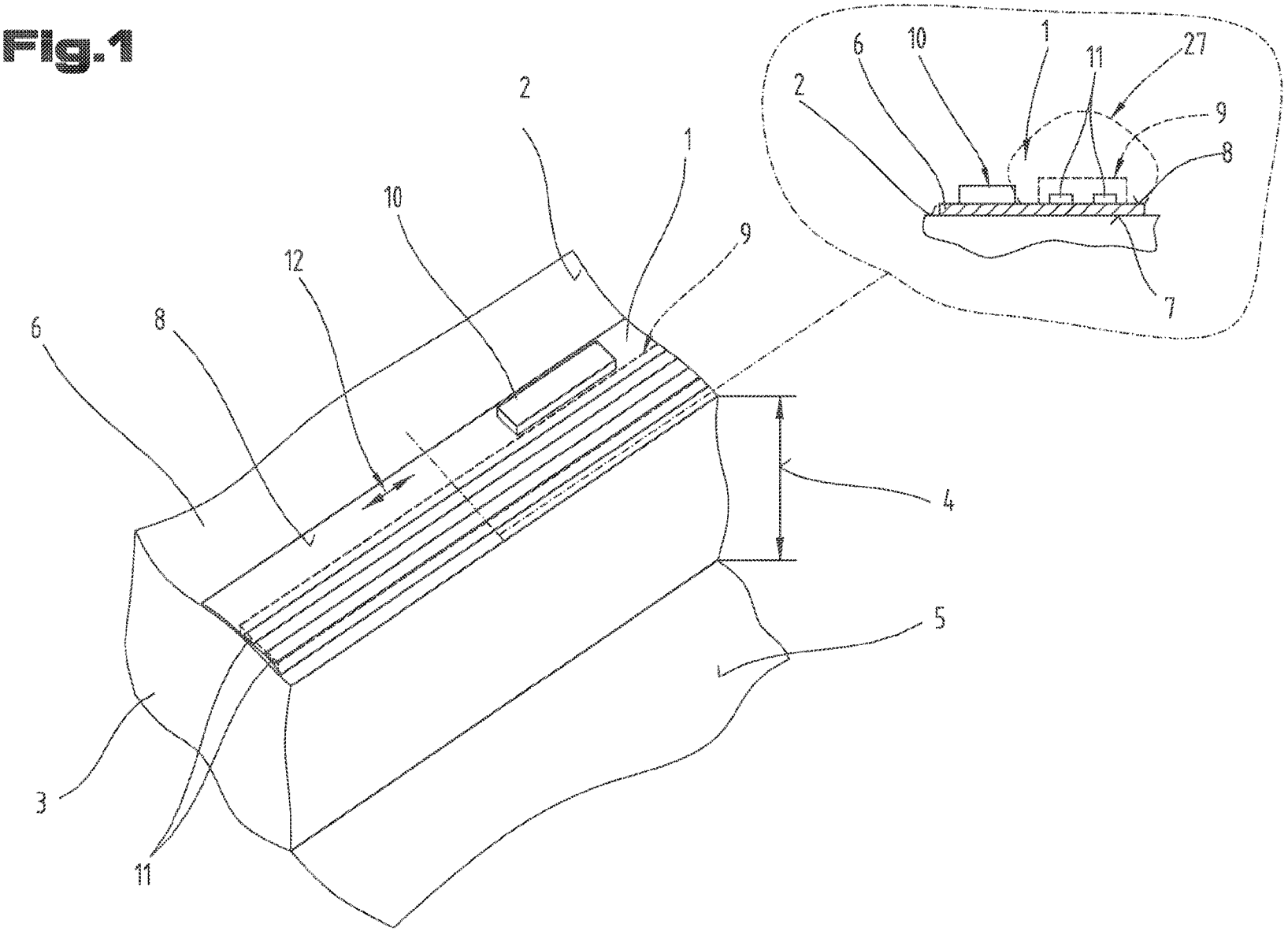

(51) Int. Cl.

| | |
|---|---|
| ***G08B 13/12*** | (2006.01) |
| ***G08B 13/24*** | (2006.01) |
| ***G07C 9/00*** | (2020.01) |
| ***G08B 13/10*** | (2006.01) |
| ***G08B 13/26*** | (2006.01) |
| ***G08B 13/14*** | (2006.01) |
| ***G08B 25/08*** | (2006.01) |

(52) U.S. Cl.
CPC ..... *G08B 13/128* (2013.01); *G08B 13/149* (2013.01); *G08B 13/2494* (2013.01); *G08B 13/26* (2013.01); *G08B 25/08* (2013.01)

(58) Field of Classification Search
USPC ..... 340/540, 541, 545.4, 551, 561, 562, 565
See application file for complete search history.

(56) References Cited

U.S. PATENT DOCUMENTS

| | | | | |
|---|---|---|---|---|
| 2008/0316027 | A1 | 12/2008 | Lefferson | |
| 2010/0283485 | A1* | 11/2010 | Valisuo ..... | G01D 5/24 324/663 |
| 2015/0276963 | A1 | 10/2015 | Casimiro et al. | |

FOREIGN PATENT DOCUMENTS

| | | | |
|---|---|---|---|
| EP | 2 133 997 | A1 | 12/2009 |
| WO | 2013/138832 | A2 | 9/2013 |
| WO | 2014/053719 | A1 | 4/2014 |

* cited by examiner

SECURITY ELEMENT FOR AN OBJECT SURFACE

CROSS REFERENCE TO RELATED APPLICATIONS

This application is the National Stage of PCT/AT2017/060167 filed on Jul. 5, 2017, which claims priority under 35 U.S.C. § 119 of Austrian Application No. A 50597/2016 filed on Jul. 5, 2016, the disclosure of which is incorporated by reference. The international application under PCT article 21(2) was not published in English.

The invention relates to a security element for an object surface.

Both in private surroundings and in commercial surroundings, there are objects that have surfaces that are oriented at least essentially horizontally, which bring with them an elevated risk of injury, either directly or indirectly. For example, heating elements can be disposed on the object surface, or the predominant surface area of the object surface can be configured as a heating surface. Examples of this are cooking devices and heating devices in private or public surroundings. However, hazardous objects can be laid down onto or disposed on the surface, and therefore can be pulled off the surface in a moment of inattentiveness. It is also possible that the object is placed ahead of an area that holds a great or very great risk of injury. For example, the object can be a piece of furniture in front of a window, or also a windowsill, which represents a great risk of falling if the window is open. This particularly holds true for babies and toddlers, since they cannot comprehensively evaluate the risk potential of objects, object surfaces, or parts that can be reached by way of these object surfaces. Aside from surfaces that are elevated relative to a base surface, openings in the base surface, such as steps or hatches, are also connected with a great risk of injury. Here, not only babies and toddlers but, in particular, also older persons and persons with impaired vision are at risk.

To detect the presence of an object, in particular a person, in the area of windows or doors, it is known from the sector of burglar alarms to detect opening of a window or door and/or detecting a movement at a defined distance from a window or door, as the presence of a person. In the case of burglar alarms, however, the concern is detecting whether a window was opened from the outside, in unauthorized manner, for example. Also, the detectable effect that results from the burglary attempt is clear and sufficiently dominant.

Furthermore, it is known, so as to secure object surfaces, that entry or access is restricted by means of mechanical barriers. For example, stove protection grilles are known, which are disposed on the object surface of the stove in a front-side section, and thereby make direct access difficult. However, the disadvantage of such an embodiment lies in that in this way, intended use is restricted or hindered. This can lead to negligence in correct placement, and thereby the security effect or protective effect is eliminated.

With regard to security against unauthorized or undesirable access, in particular by toddlers and babies, the height of the object to be secured already represents a barrier, which usually cannot be overcome or reached. Also, the object height, for example a masonry wall, can be explicitly designed as mechanical access protection. However, toddlers and babies, in particular, are curious explorers and want to reach unknown territories, so that ways and means are found to overcome the constructional barrier.

Furthermore, optical systems are known, in which interruption of a light beam or a light curtain is detected, and based on this, an action is triggered, for example an alarm is sounded.

Aside from purely mechanical systems that form an access barrier, apparatuses and systems are known, above all from burglar alarm technology, which are supposed to detect unauthorized access "from the outside." In the case of such systems, it is necessary that manipulation of the security system is not possible or is only possible with difficulty, but that in any case, manipulation is detected. For this reason, the presence sensor and an evaluation circuit are generally disposed at a spatial distance from one another, and this, in particular, makes placement by untrained operators difficult and brings with it a clear installation effort and expense.

The task of the invention therefore lies in creating a universal, compact system, which has a particularly simple structure both in terms of production and in placement or use. It is furthermore the task of the invention to configure the system in such a manner that it can be used on a plurality of different object surfaces, in particular without additional effort due to a specific assembly.

The task of the invention is accomplished by means of a security element for an object surface, which object surface is at a distance from a floor surface, due to a vertical distance, in particular an object height or depth. The security element comprises an elongated support body in the shape of a flat profile, having a first and a second flat side, wherein the support body is configured with the first flat side to be placed on the object surface. A presence sensor and an evaluation unit are disposed on the second flat side; furthermore, the support body is formed by a flexible material. The presence sensor has a detection region, which detection region extends, proceeding from the second flat side, in the spatial direction of the direction facing away from the first flat side, around the presence sensor.

The detection region is formed by a near region, in particular by a region smaller than 15 cm; furthermore, the evaluation unit has an electrical energy storage unit. The presence sensor forms a measurement unit having an electrical characteristic value, and has at least two electrically conductive electrodes, which electrodes are configured essentially over the entire longitudinal expanse of the support body.

Preferably, the structural or constructional embodiment will be such that the component or the element is essentially oriented vertically between the surface to be secured and the floor surface. This is supposed to allow an adult person who is standing to have unhindered access, to the greatest possible extent, or, in the case of access security, reaching the surface is supposed to be made difficult. In the case of accessibility for adults, the object height will lie in the range of 75 cm to 110 cm. If easy accessibility is to be prevented, the object height will be greater than 200 cm.

Preferably, the security element will be disposed on top of or on the side of the surface to be secured with its first flat side. Due to the configuration of the electrodes along the entire longitudinal expanse, it can be achieved or guaranteed that the surface cannot be reached by the group of persons being considered, without getting into the detection region of the presence sensor.

In this document, a flexible support layer is understood to mean that it can be applied to uneven surfaces, if necessary, without being damaged. In particular, the elasticity is selected in such a manner, i.e. a user will deform the security element only in such a manner that in the case of intended placement, the support layer and the presence sensor and the evaluation unit disposed on it are not damaged.

The electrodes are essentially configured over the entire longitudinal expanse of the support body, which means that they can be configured from edge to edge of the elongated support layer. However, this is also understood to mean that the ends of the electrodes can be configured with a distance from the ends of the support layer.

According to a further development, it is provided that the presence sensor has three electrically conductive electrodes. In this way, the result is achieved that a direction of an approach that has occurred or of access that has taken place can be detected. Since the electrodes are configured along the longitudinal expanse, two detection regions can be defined with three electrodes. The direction from which an approach or access took place can be established by means of an evaluation of the detection of a presence in one of the two regions, or the evaluation of a time progression of the presence detection of the two regions.

Furthermore, an embodiment is advantageous, according to which the electrodes are configured as strip electrodes that are oriented parallel to one another. Such strip electrodes can be produced very easily, by means of rolling them up, printing them, etc.; above all, fast and efficient preparation of the presence sensor is possible in this way.

An embodiment according to which the electrodes are configured in meander shape is also advantageous, since in this way, an increase in size of the useful length is achieved. In this way, additional sensor elements can be provided, for example, or the output signal of a length-dependent electrical characteristic value can be amplified, without requiring an additional active amplifier for this purpose.

An advantageous embodiment is also achieved in that the electrodes form a capacitor, in particular an air capacitor having a capacitive impedance. In this simplest embodiment, an electrical field forms between the electrodes, which field is influenced by the presence or approach of a body, and thereby the capacitance and thus the impedance value are changed.

According to a further development, it is also provided that a force sensor and/or temperature sensor and/or light sensor is disposed on the electrodes, electrically connected with them, in particular a piezoelectric sensor or a resistive sensor. By means of a piezoelectric sensor, it is possible to draw directly conclusions regarding the force acting on it, by way of the voltage produced. With regard to use as baby security or child security, it is possible to draw a conclusion, by way of the determined force, as to whether the force effect was brought about by a toddler or by a baby, and to react to this accordingly, if necessary. A resistive sensor can also be configured as a force sensor, for example as a strain gauge. However, it is also possible that a resistive sensor forms a temperature sensor or a light-dependent resistor. If a human body moves into the detection region of the presence sensor and touches it, the body will influence the temperature of the presence sensor and thereby its electrical characteristic value. In the case of presence in the detection region, a shadow falling on the presence sensor will also occur, and thereby a sensor configured as a light-dependent resistor will change its electrical characteristic value. A movement in the surroundings of the sensor can already be detected by means of a motion-detection sensor. In this case, the sensor is preferably configured as a pyro-electric sensor.

According to a further development, it is provided that an adhesive layer is applied on the first flat side. This can be, for example, and not conclusively, a layer of adhesive, a double-sided adhesive tape. In this way, the support layer can be subsequently placed on any surface for which an adhesion layer is available.

To protect the security element, it is provided, according to a further embodiment, that a cover film that projects beyond the base surface of the support body, in a top view, is provided on the side of the second flat side, wherein a surface of the cover film that faces the second flat side has an adhesion layer. According to this embodiment, the security element can be placed on the surface to be secured, and is fixed in place on this surface by or by means of the cover film. Since the cover film projects beyond the base surface, in particular projects beyond it on all sides, sealing with regard to influences of the surroundings or mechanical protection against damage can additionally be implemented.

A further embodiment also consists in that the evaluation unit has an electronic circuit that is configured for evaluation of a change in the electrical characteristic value of the measurement unit. For example, the electrical characteristic value can be directly placed in a circuit as a variable that determines the behavior of the circuit. In the case of a capacitive impedance, this could serve as a frequently-determining capacitance of an oscillating circuit. Or the electrical characteristic is evaluated, in that it is measured without thereby influencing the characteristic value. For example by means of a high-ohm voltage measurement.

Furthermore, an embodiment according to which the evaluation unit has a wireless communications interface is advantageous. For example, this can be a HF interface, in particular a near-range communications method such as Bluetooth, Zigbee, and WiFi. However, an IR interface is also conceivable, wherein here, a visual connection with the remote reception station must exist in clear manner. With this further development, the result can be achieved that an evaluation signal of the evaluation unit can be transmitted to a locally remote central station. In particular, in this way multiple present security elements can also be connected with at least one central station. Furthermore, in this way unrestricted placement of the security element, to the greatest possible extent, becomes possible, since no cable connection must be built up between the security element and a central station.

A further development also consists in that the evaluation unit has an electrical energy source. With this embodiment, a long, autarchic period of operation is guaranteed.

A further development also consists in that a photovoltaic element is disposed on the electrodes, in particular a segmented element. The presence detection can also be carried out by means of evaluation of a change in brightness. If an object or a person approaches the sensor, the light conditions in the region of the presence sensor will change. This can be utilized so as to detect the presence and, if applicable, also the size of the object. Adults will generally cover a larger region of the presence sensor than children. Additionally, differentiation of the presence detection is made possible by means of possible segmentation. Because of the different voltage values that are emitted, which are essentially proportional to the amount of light falling onto the segment, determination of a movement direction or of an approach direction is made possible.

An advantageous further development also consists in that the photovoltaic element forms the electrical energy source. With this further development, a combination of the sensor system with the energy supply is achieved, and thereby a more compact structure of the security element is achieved.

Furthermore, a further embodiment, according to which the evaluation unit has an alarm transmitter that is configured for emitting an alarm if a limit value of the electrical characteristic value of the measurement unit is exceeded and/or not reached is advantageous. A minimum/maximum force effect or approach up to a minimum distance or detected presence in a defined region, for example, can be established as a limit value.

A further development can also consist in that the energy source is formed by a photovoltaic element, which is preferably connected with the energy storage unit. In this way, completely autarchic operation of the security element can be guaranteed. Preferably, the photovoltaic element will be connected with the energy storage unit by way of a charging regulator, so as to store energy in the unit in defined and controlled manner.

With regard to the most reliable operation possible, it can be provided, according to a further development, that the evaluation unit has an activation circuit, which is configured to switch the evaluation unit between operation at rest and detection operation. It can be, for example, that in the case of intended utilization or use of the object to be secured, the security element does not need to be active—or also is not allowed to be active, so as to prevent false error messages. Therefore it is advantageous if the security element is only active in the case of non-intended use. This activation circuit can be formed by a switch or by detection of an active state or busy state, for example. Intended use is understood here to mean use of the object that does not lead to any hazard situation of the use, in any case.

In contrast, an advantageous further development consists in that the activation circuit is configured in mechanically contact-free manner. This can be implemented, for example, by way of a solenoid switch or an optical interruption switch or reflection switch.

A further development according to which the support body is configured so that it can be shortened in any or segmented manner, but keeping a minimum length, is also advantageous. In this way, production is clearly simplified, since only a small product variation needs to be produced. The length actually required is established on site, during installation or placement. In particular, the presence sensor is designed in such a manner that its electrical characteristic value will possibly change due to its shortening, but no impairment of or interference with the electrical characteristic value will come about. According to a further development, it can also be provided that the evaluation unit or the presence sensor carries out self-calibration after being put into operation, so as to define a reference value for further person detection.

An embodiment consists in that the object is formed by a windowsill, or a large kitchen appliance, or a piece of furniture, or by an access barrier.

A further development also consists in that the presence sensor and the evaluation unit are placed next to one another and without any overlap. With this further development, it is possible to achieve a particularly flat structure of the security element. Also, in this way it is guaranteed that the least possible influence on or restriction of the presence sensor is provided.

A further development also consists in that a thickness of the support body and of the presence sensor and the evaluation unit disposed on it form a height, which height has a value of less than 2 mm.

According to a further embodiment, the near region is formed by a region smaller than 5 mm. With this configuration, it is guaranteed, in advantageous manner, that detection of a presence takes place only in a very restricted, narrow field around the security element. This is advantageous, among other things, if much movement prevails in the surroundings of the object to be secured, for example if many people are present there, but an overly close approach to an object must be detected.

To this effect, a further embodiment consists in that the near region is configured as a contact region. In this way, the result is achieved that only touching, direct contact, will lead to evaluation or to a reaction.

For a better understanding of the invention, it will be explained in greater detail using the following figures.

Figure 2A:
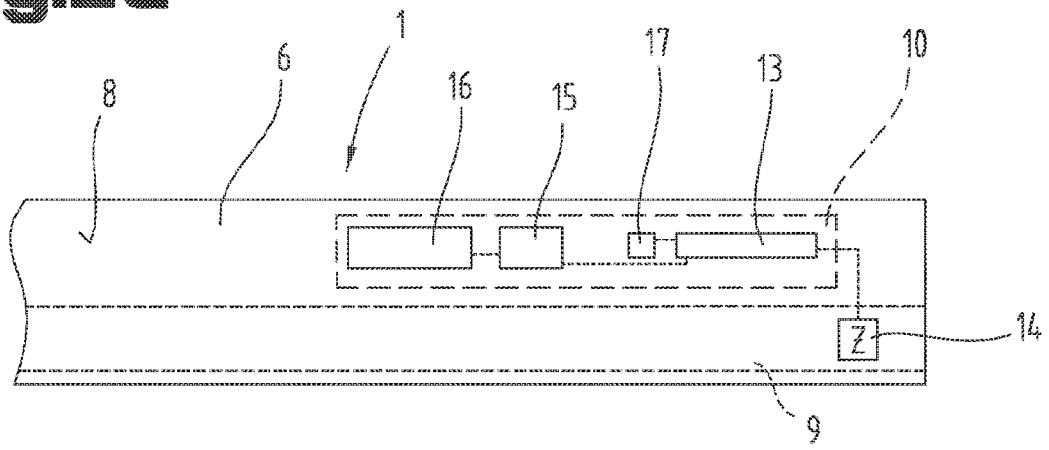

The figures show, each in a greatly simplified, schematic representation:

FIG. 1 the present security element, placed on an object to be secured;

FIG. 2*a*) to *c*), possible embodiments of the security element;

FIG. 3*a*) a monitoring system comprising multiple security elements;

*b*) an electrical circuit schematic of the security element.

FIG. 1 shows the present security element 1, which is placed on an object surface 2 of an object 3 to be secured. The object surface 2 is spaced apart from a floor surface 5 by an object height 4.

The security element 1 comprises an elongated support body 6 in the form of a flat profile, having a first 7 and a second 8 flat side, wherein the support body 6 is placed on the object surface 2 with a first flat side 7. Preferably, for this purpose an adhesion layer, for example a double-sided adhesive tape, is applied to the first flat side 7. A presence sensor 9 and an evaluation unit 10 are disposed on the second flat side 8.

The presence sensor 9 extends over the entire longitudinal expanse 12 of the support body 6, wherein a possible embodiment of the presence sensor 9 is shown in FIG. 1, by means of two electrically conductive electrodes 11. In the embodiment variant shown, the electrodes 11 are structured as strip electrodes that are oriented parallel to one another. According to advantageous further developments, however, it is also possible that three electrically conductive electrodes are provided to change or adapt the detection characteristics, or that the electrodes are configured in meander shape, so as to thereby achieve an increase in sensitivity, for example.

Figure 2B:
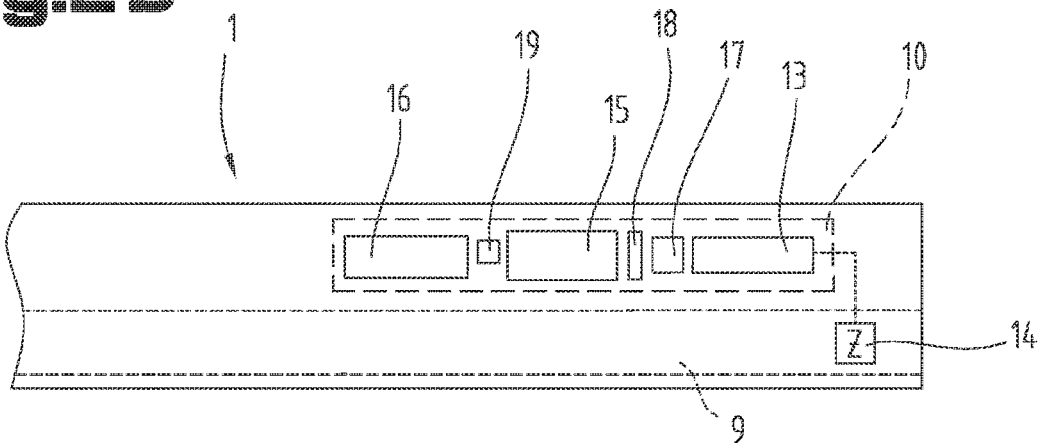
Figure 2C:
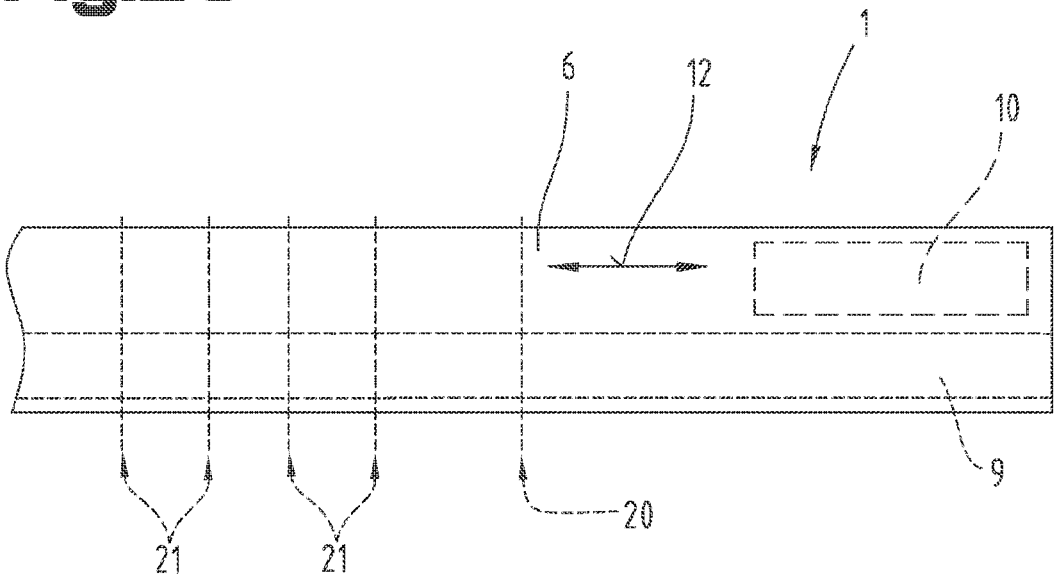
Figure 9A:
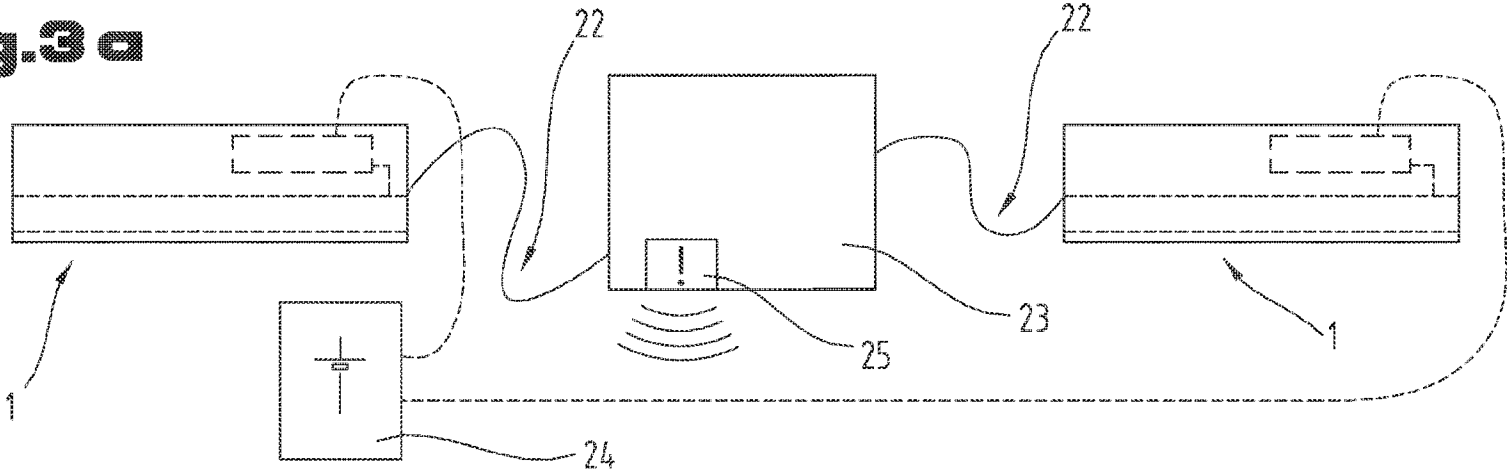
Figure 9B:
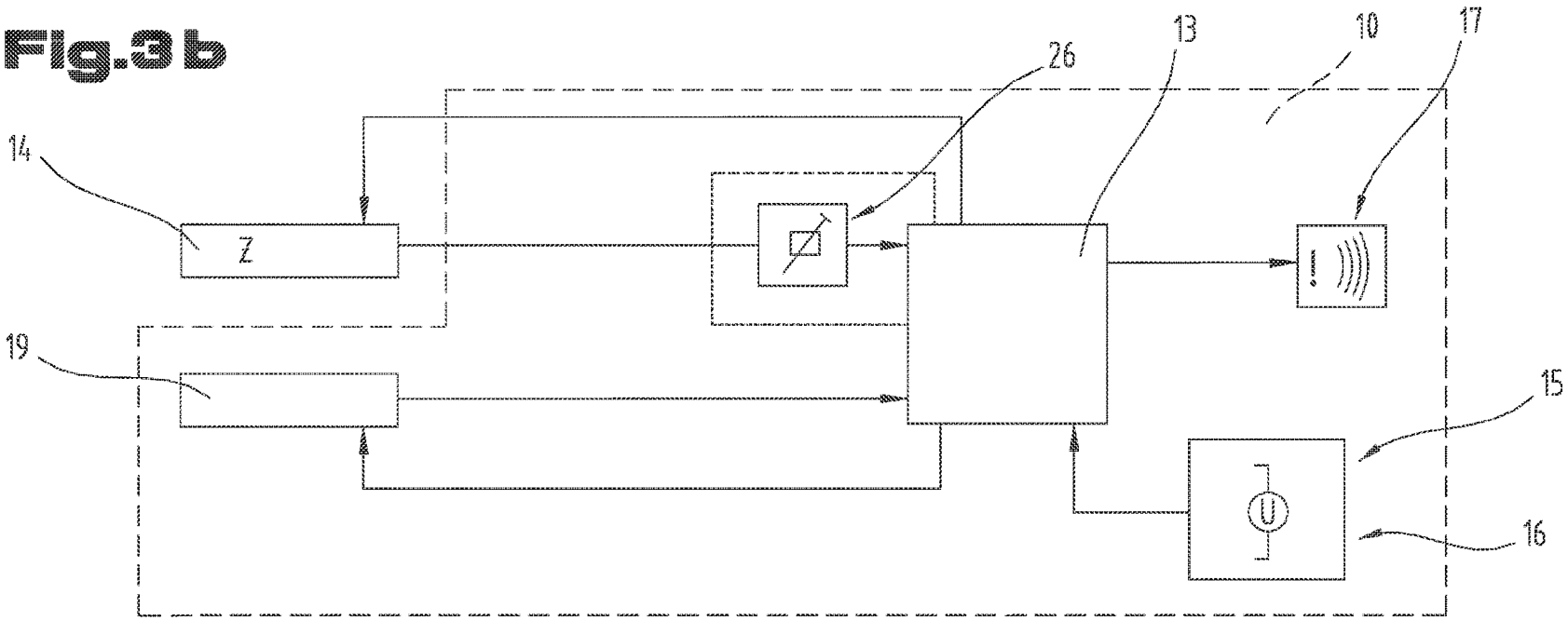

FIGS. 2*a* to 2*c* show possible embodiment variants of the present security element. For reasons of simplification, the object or the object surface to be secured, on which the security element is disposed, is not shown.

FIG. 2*a* shows a first possible embodiment of the security element 1. The presence sensor 9 and the evaluation unit 10 are disposed on the second flat side 8 of the support body 6. The presence sensor 9, in particular the electrodes of the presence sensor, form a measurement unit 14 having an electrical characteristic value. The evaluation unit 10 has an electronic circuit 13, which is configured for evaluation of a change in the electrical characteristic value of the measurement unit 14.

Furthermore, an electrical energy storage unit 15 and/or an electrical energy source 16 is/are connected with the electronic circuit 13. The energy storage unit 15 can be configured as a battery, a rechargeable battery or as a capacitor (supercap), for example. However, it is also possible that the energy source 16 is formed by a photovoltaic element, which is preferably connected with the energy storage unit 15. The evaluation unit 10 can furthermore have an alarm transmitter 17, so as to be able to immediately emit an alarm in the event of detection of the presence of an object in the detection region of the presence detector. This alarm transmitter 17 can be configured for optical and/or acoustical emission of alarm signals, for example as a flashing light, an LED flash and/or as a loudspeaker.

In the sectional detail representation, it is shown that the presence sensor 9 has a detection region 27 that extends into the spatial region of the second flat side 8. The main expanse direction of the detection region 27 can be established as a function of and so as to be influenced by the configuration of the measurement unit 14. For example, a club-type detection characteristic can be formed, in which the main sensitivity of the detection region 27 is directed essentially away from the second flat side 8. However, a circular or semicircular or elliptical cross-section is possible, so that the detection region 27 has a sensitivity in the direction approximately parallel to the second flat side 8.

FIG. 2*b* shows a further possible embodiment of the present security element 1. In this embodiment, elements of the evaluation unit 10 are provided supplementally or alternatively to the embodiment shown in FIG. 2*a*. To simplify the representation, connection lines between individual elements of the evaluation unit 10 were left out; the connections are described below. The evaluation unit 10 has an electronic circuit 13, which is configured for evaluation of an electrical characteristic value of a measurement unit 14.

Aside from local alarm emission by an alarm transmitter 17, it can also be provided that the evaluation unit 10 has a wireless communication interface 18, by way of which the security element 1 can be connected with a central controller. The communications interface is preferably configured as a HF interface, but configuration as an optical interface (particularly IR) or acoustical interface (particularly ultrasound) is also possible. According to a further possible embodiment, the energy source 16 can be configured by a remote station for wireless energy transmission. In this way, completely independent and continuous operation is made possible, in that the security element 1 is supplied with electrical energy from an external remote station.

An advantageous further development also consists in that the security element 1, in particular those parts of the electronic circuit 13 that evaluate the electrical characteristic value of the measurement unit 14, are active only when needed. For this reason, it can also be provided that the evaluation unit 10 has an activation circuit 19, which is configured for switching the evaluation unit 10, in particular the electronic circuit 13, between a rest state and a detection state. For example, the present security element can be placed on a windowsill, wherein detection of the presence of an object is only necessary when the window is open. The activation circuit 19 is preferably configured in mechanically contact-free manner, and can be formed, for example, by a (magnetic) field switch, but an embodiment as an optical reflex switch is also possible.

FIG. 2*c* shows a further possible advantageous embodiment of the present security element 1. Since the electrically conductive electrodes of the presence sensor 9 extend over the entire longitudinal expanse, individual adaptation of the entire length of the security element 1 to the local conditions is possible. In particular, it is possible that the security element 1 can be shortened to the desired length by the end customer or user himself/herself. In order to guarantee that the electrical characteristic value of the measurement unit 14 of the presence sensor 9 reaches a sufficient value that can be evaluated, it is provided that the support body 6 and thereby the security element 1 must have a specific minimum length 20. Starting from this length, it can be provided that the support body 6 can be shortened at specific or optional positions 21, without impairing the function of the presence sensor 9, in particular of the electrodes. This is particularly advantageous with regard to the most efficient production possible, since in this way, the support body 6 with the presence sensor 9 can be produced as an endless product, on which an evaluation unit 10 is disposed at regular intervals.

In FIGS. 1 and 2, the evaluation unit 10 and the presence sensor 9 are disposed next to one another and without overlap on the second flat side 8. This embodiment has the advantage that in this way, a very flat security element can be formed. However, according to a further development, not shown, it is also possible that the evaluation unit 10 is disposed, in part or entirely, on or above the presence sensor 9 in a partial section of the presence sensor. A further embodiment can also consist in that the security element has a multi-layer construction, so that the evaluation unit 10 can be disposed on the support body 6, for example. Or the presence sensor 9 is disposed above the evaluation unit 10 on the second flat side 8.

FIG. 3*a* shows a possible embodiment of a security system, in which multiple security elements 1 are connected with a central unit 23, in each instance, by way of a communications connection 22 that is preferably configured in wireless manner. In the embodiment shown, it is furthermore provided that the security elements 1 are supplied with electrical energy by a central energy supply module 24, wherein wireless transmission of electrical energy is preferred. The central unit 23 is now configured to evaluate the plurality of the security elements 1, and, specifically, in particular taking into consideration a sequence pattern of detected presences, to be able to emit an optical and/or acoustical alarm by a signal transmitter 25. A more complex evaluation pattern of detected presences of an object in the detection region of a security element 1 can consist in that an alarm is only emitted if the individual security elements 1 detect a presence of an object in the detection region in a specifically established sequence. In this way, false alarms can be reduced.

FIG. 3*b* shows an electrical block schematic of the components of the evaluation unit 10. The evaluation unit 10 comprises an electronic circuit 13 that is connected with the measurement unit 14 of the presence sensor and evaluates the electrical characteristic value of the measurement unit 14. If applicable, an automatic adjustment module 26 is interposed, so as to establish a rest state or a rest value of the electrical characteristic value of the measurement unit 14. Furthermore, the measurement unit 14 or the presence sensor is supplied with electrical energy from an energy storage unit 15 or an energy source 16, by way of the electronic circuit 13. The supply with electrical energy can now take place continuously or cyclically. However, it is also possible that it is detected, by way of an activation circuit 19, whether detection of the presence of an object in the detection region is to be carried out. Outside of the detected need for presence detection, the electronic circuit 13 and, in particular, the presence sensor or the measurement unit 14 can be put into a particularly energy-saving rest state. If the electronic circuit 13 determines a presence of an object in the detection region of the presence sensor, due to a change in the electrical characteristic value of the measurement unit 14, an optical and/or acoustical signal is emitted by way of an alarm transmitter 17.

In the figure description, possible embodiment variants are described making reference to an object to be secured, which object is elevated by an object height relative to the floor surface. It is explicitly stated that the present security element is also suitable and can be used for securing openings in the floor, such as stairs, for example. The descriptions listed herein are therefore also applicable to a "negative" object height.

The particular advantage of the present security element lies in that an autarchic system was created, which can be disposed on any surface, to the greatest possible extent, due to the flexible structure of the support body, and can perform presence monitoring there without further interaction with or attention from a user. If a presence is detected, an alarm is issued automatically, so that a user can react and avert possible endangerment.

In conclusion, it should be stated that in the different embodiments described, the same parts are provided with the same reference symbols or component designations, wherein the disclosures contained in the description as a whole can be applied analogously to the same parts having the same reference symbols or the same component designations. Also, the position information chosen in the description, such as at the top, at the bottom, on the side, etc., refer to the figure being directly described and shown, and this position information must be transferred analogously to a new position in the event of a change in position.

In FIGS. 2 and 3, further embodiments of the security element, which can be independent, are shown, wherein once again, the same reference symbols or component designations are used for the same parts as in the previous figures. In order to avoid unnecessary repetition, reference is made to the detailed description in the preceding figures, i.e. this is pointed out.

The exemplary embodiments show possible embodiment variants, wherein it should be noted at this point that the invention is not restricted to the specifically shown embodiment variants of the same, but rather diverse combinations of the individual embodiment variants with one another are also possible, and this variation possibility lies within the ability of a person skilled in the art of the technical field, on the basis of the teaching for technical action provided by the present invention.

The scope of protection is determined by the claims. However, the description and the drawings should be used for an interpretation of the claims. Individual characteristics or combinations of characteristics of the different exemplary embodiments that are shown and described can represent independent inventive solutions on their own. The task on which the independent inventive solutions are based can be derived from the description.

All the information regarding value ranges in the present description should be understood to mean that any and all partial ranges of them are included; for example, the information 1 to 10 should be understood to mean that all partial ranges, proceeding from a lower limit of 1 and including the upper limit of 10, are included, i.e. all partial ranges begin with a lower limit of 1 or greater and end at an upper limit of 10 or less, for example 1 to 1.7, or 3.2 to 8.1, or 5.5 to 10.

For the sake of good order, it should be pointed out, in conclusion, that for a better understanding of the structure, some elements were shown not to scale and/or enlarged and/or reduced in size.

REFERENCE SYMBOL LISTING

1 security element
2 object surface
3 object to be secured
4 object height
5 floor surface
6 support body
7 first flat side
8 second flat side
9 presence sensor
10 evaluation unit
11 electrodes
12 longitudinal expanse
13 electronic circuit
14 measurement unit
15 energy storage unit
16 energy source
17 alarm transmitter
18 communications interface
19 activation circuit
20 minimum length
21 position
22 communications connection
23 central unit
24 energy supply module
25 signal transmitter
26 adjustment module
27 detection region

The invention claimed is:

1. A security element (1) for an object surface (2), which object surface (2) is at a distance from a floor surface (5), due to a vertical distance, in particular an object height (4) or depth, comprising an elongated support body (6) in a shape of a flat profile, having a first (7) and a second (8) flat side, wherein the support body (6) is configured with the first flat side (7) to be placed on the object surface (2), and wherein a presence sensor (9) and an evaluation unit (10) are disposed on the second flat side (8), and wherein the presence sensor (9) has a detection region (27), which detection region (27) extends, proceeding from the second flat side (8), in a spatial direction of the direction facing away from the first flat side (7), around the presence sensor (9), and wherein the support body (6) is formed from a flexible material, wherein the detection region (27) is formed by a near region, in particular by a region smaller than 15 cm, and wherein the evaluation unit (10) has an electrical energy storage unit (15), and wherein the presence sensor (9) forms a measurement unit (14) having an electrical characteristic value, and furthermore has at least two electrically conductive electrodes (11), which electrodes (11) are configured essentially over an entire longitudinal expanse (12) of the support body (6).

2. The security element according to claim 1, wherein the presence sensor (9) has three electrically conductive electrodes (11).

3. The security element according to claim 1, wherein the electrodes (11) are configured as strip electrodes oriented parallel to one another.

4. The security element according to claim 1, wherein the electrodes (11) are configured in meander shape.

5. The security element according to claim 1, wherein the electrodes (11) form a capacitor, in particular an air capacitor, having a capacitive impedance.

6. The security element according to claim 1, wherein at least one element selected from the group consisting of a force sensor temperature sensor light sensor and a motion detection sensor is disposed on the electrodes (11), electrically connected with the electrodes (11), in particular a piezoelectric sensor or a resistive sensor or a pyroelectric sensor.

7. The security element according to claim 1, wherein an adhesive layer is applied to the first flat side (7).

8. The security element according to claim 1, wherein a cover film that projects beyond the base surface of the support body (6), in a top view, is provided on the side of the second flat side (8), wherein a surface of the cover film that faces the second flat side (8) has an adhesion layer.

9. The security element according to claim 1, wherein the evaluation unit (10) has an electronic circuit (13) that is configured for evaluation of a change in the electrical characteristic value of the measurement unit (14).

10. The security element according to claim 1, wherein the evaluation unit (10) has a wireless communications interface (18).

11. The security element according to claim 1, wherein the evaluation unit (10) has an electrical energy source (16).

12. The security element according to claim 11, wherein a photovoltaic element is disposed on the electrodes (11), in particular a segmented element.

13. The security element according to claim 12, wherein the photovoltaic element forms the electrical energy source.

14. The security element according to claim 11, wherein the evaluation unit (10) has an alarm transmitter (17) that is configured for emitting an alarm if a limit value of the electrical characteristic value of the measurement unit (14) is exceeded or not reached.

15. The security element according to claim 11, wherein the energy source (16) is formed by a photovoltaic element that is preferably connected with the energy storage unit (15).

16. The security element according to claim 1, wherein the evaluation unit (10) has an activation circuit (19), which is configured to switch the evaluation unit (10) between operation at rest and detection operation.

17. The security element according to claim 16, wherein the activation circuit (19) is configured in mechanically contact-free manner.

18. The security element according to claim 1, wherein the support body (6) is configured so that it can be shortened in any desired manner or segmented manner, but keeping a minimum length (20).

19. The security element according to claim 1, wherein the object is formed by a windowsill, or a large kitchen appliance, or a piece of furniture, or an access barrier.

20. The security element according to claim 1, wherein the presence sensor (9) and the evaluation unit (10) are disposed next to one another and without overlap.

21. The security element according to claim 1, wherein a thickness of the support body (6) and of the presence sensor (9) disposed on it and of the evaluation unit (10) form a height, which height has a value less than 2 mm.

22. The security element according to claim 1, wherein the near region is formed by a region smaller than 5 mm.

23. The security element according to claim 1, wherein the near region is configured as a contact region.

* * * * *